US006502442B2

(12) United States Patent
Arola et al.

(10) Patent No.: US 6,502,442 B2
(45) Date of Patent: Jan. 7, 2003

(54) METHOD AND APPARATUS FOR ABRASIVE FOR ABRASIVE FLUID JET PEENING SURFACE TREATMENT

(75) Inventors: Dwayne D. Arola; Mark L. McCain, both of Catonsville, MD (US)

(73) Assignee: University of Maryland Baltimore County, Baltimore, MD (US)

( * ) Notice: Subject to any disclaimer, the term of this patent is extended or adjusted under 35 U.S.C. 154(b) by 0 days.

(21) Appl. No.: 09/852,779

(22) Filed: May 11, 2001

(65) Prior Publication Data

US 2001/0047675 A1 Dec. 6, 2001

Related U.S. Application Data

(60) Provisional application No. 60/203,404, filed on May 11, 2000.

(51) Int. Cl.[7] ..... B24C 1/10; B21J 51/28

(52) U.S. Cl. ..... 72/53; 29/90.7; 451/39; 451/40; 433/201.1

(58) Field of Search ..... 72/53; 29/90.7; 451/39, 40; 433/201.1

(56) References Cited

U.S. PATENT DOCUMENTS

| | | | | | |
|---|---|---|---|---|---|
| 3,410,124 | A | * | 11/1968 | Suwa | 72/53 |
| 3,754,976 | A | * | 8/1973 | Babecki et al. | 72/53 |
| 4,380,138 | A | | 4/1983 | Hofer | |
| 4,614,100 | A | * | 9/1986 | Green et al. | 29/90.7 |
| 4,872,293 | A | | 10/1989 | Yasukawa et al. | |
| 5,018,317 | A | | 5/1991 | Kiyoshige et al. | |
| 5,184,434 | A | | 2/1993 | Hollinger et al. | |
| 5,251,468 | A | * | 10/1993 | Lin et al. | 29/90.7 |
| 5,305,361 | A | * | 4/1994 | Enomoto et al. | 72/53 |
| 5,327,755 | A | | 7/1994 | Thompson | |
| 5,354,390 | A | * | 10/1994 | Haszmann et al. | 451/40 |
| 5,460,025 | A | | 10/1995 | Champaigne | |
| 5,527,204 | A | | 6/1996 | Rhoades | |
| 5,592,841 | A | | 1/1997 | Champaigne | |
| 5,679,058 | A | | 10/1997 | Rhoades | |
| 5,704,239 | A | * | 1/1998 | Beals et al. | 29/90.7 |
| 5,704,824 | A | | 1/1998 | Hashish et al. | |
| 5,778,713 | A | | 7/1998 | Butler et al. | |
| 5,964,644 | A | * | 10/1999 | Rhoades | 451/39 |
| 6,012,316 | A | * | 1/2000 | Lange et al. | 72/53 |
| 6,135,857 | A | * | 10/2000 | Shaw et al. | 451/39 |
| 6,183,255 | B1 | * | 2/2001 | Oshida | 433/201.1 |

* cited by examiner

*Primary Examiner*—David Jones
(74) *Attorney, Agent, or Firm*—Wenderoth, Lind & Ponack, L.L.P.

(57) ABSTRACT

An abrasive water treatment method and apparatus includes supporting a metal workpiece on a workpiece support and arranging a nozzle above a target surface of the workpiece so that the nozzle is pointed towards the target surface of the workpiece. A pressurized fluid having entrained abrasive particles is then generated and discharged through the nozzle and toward the target surface of the workpiece. The nozzle is located a texturing standoff distance from the target surface such that the periphery of the pressurized fluid stream discharged from the nozzle expands after being discharged from the nozzle and prior to impinging upon the target surface of the workpiece. As a result, a textured surface is created on the workpiece.

21 Claims, 8 Drawing Sheets

| Experiment | Pressure (MPa) | Abrasive (mesh #) | Standoff (m) | Traverse Speed (m/min) |
|---|---|---|---|---|
| 1 | 280 | 50 | 0.15 | 0.38 |
| 2 | 280 | 80 | 0.15 | 0.38 |
| 3 | 280 | 120 | 0.15 | 0.38 |
| 4 | 210 | 50 | 0.15 | 0.38 |
| 5 | 210 | 80 | 0.15 | 0.38 |
| 6 | 210 | 120 | 0.15 | 0.38 |
| 7 | 140 | 50 | 0.15 | 0.38 |
| 8 | 140 | 80 | 0.15 | 0.38 |
| 9 | 140 | 120 | 0.15 | 0.38 |
| 10 | 80 | 50 | 0.15 | 0.38 |
| 11 | 80 | 80 | 0.15 | 0.38 |
| 12 | 80 | 120 | 0.15 | 0.38 |

FIG. 2

| Specimen | $R_a$ (μm) | $\bar{R}_z$ (μm) | $R_y$ (μm) | $R_k$ (μm) | $R_{pk}$ (μm) | $R_{vk}$ (μm) | $M_{r1}$ % | $M_{r2}$ % |
|---|---|---|---|---|---|---|---|---|
| AWJ peen | | | | | | | | |
| 1 | 14.2 | 76.7 | 95.8 | 46.9 | 20.9 | 21.8 | 12.6 | 89.2 |
| 2 | 11.0 | 60.8 | 84.5 | 34.9 | 16.2 | 16.7 | 7.6 | 86.5 |
| 3 | 7.6 | 42.6 | 54.2 | 26.4 | 10.5 | 8.1 | 7.6 | 91.2 |
| 4 | 12.2 | 64.5 | 86.4 | 40.2 | 16.8 | 15.6 | 9.9 | 89.8 |
| 5 | 9.4 | 51.8 | 74.6 | 31.7 | 12.6 | 11.1 | 7.8 | 89.5 |
| 6 | 6.3 | 35.9 | 43.7 | 20.8 | 7.6 | 7.0 | 9.9 | 88.8 |
| 7 | 10.1 | 53.8 | 69.7 | 31.6 | 10.8 | 15.4 | 7.0 | 85.5 |
| 8 | 8.9 | 49.4 | 61.1 | 28.3 | 7.4 | 13.9 | 8.1 | 86.5 |
| 9 | 4.7 | 30.3 | 35.5 | 14.4 | 5.0 | 7.7 | 6.5 | 85.3 |
| 10 | 7.6 | 44.5 | 59.0 | 26.1 | 7.3 | 13.9 | 4.9 | 90.6 |
| 11 | 5.7 | 33.9 | 44.5 | 19.2 | 5.7 | 7.5 | 8.8 | 91.1 |
| 12 | 3.6 | 21.9 | 30.0 | 10.9 | 3.5 | 7.1 | 9.2 | 87.4 |
| Plasma Spray | 28.9 | 144.9 | 186.4 | 95.6 | 15.7 | 59.5 | 7.3 | 85.1 |

FIG. 3

| Specimen | $\rho_v$ (μm) | $K_t$ | $V_t$ ($\mu m^3/\mu m^2$) |
|---|---|---|---|
| AWJ peen | | | |
| 1 | 11.0 | 2.6 | 43.8 |
| 2 | 14.2 | 2.1 | 35.2 |
| 3 | 35.0 | 1.3 | 23.8 |
| 4 | 14.2 | 2.1 | 36.9 |
| 5 | 18.8 | 1.7 | 28.9 |
| 6 | 12.3 | 1.6 | 18.1 |
| 7 | 7.8 | 2.7 | 28.5 |
| 8 | 11.3 | 2.0 | 22.9 |
| 9 | 17.7 | 1.3 | 13.1 |
| 10 | 28.8 | 1.3 | 21.4 |
| 11 | 13.7 | 1.5 | 15.4 |
| 12 | 14.2 | 1.3 | 9.4 |
| Plasma Spray | 5.0 | 8.4 | 71.0 |

FIG. 4

| Experiment | Pressure (MPa) | Abrasive (mesh #) | Stress (MPa) |
|---|---|---|---|
| 1 | 280 | 50 | 88±55 |
| 2 | 280 | 80 | 128±57 |
| 3 | 280 | 120 | 196±39 |
| 4 | 210 | 50 | 142±41 |
| 5 | 210 | 80 | 181±56 |
| 6 | 210 | 120 | 186±56 |
| 7 | 140 | 50 | 186±57 |
| 8 | 140 | 80 | 184±47 |
| 9 | 140 | 120 | 318±36 |
| 10 | 70 | 50 | 266±55 |
| 11 | 70 | 80 | 240±44 |
| 12 | 70 | 120 | 353±56 |

FIG. 5

PRIOR ART

METHOD AND APPARATUS FOR ABRASIVE FOR ABRASIVE FLUID JET PEENING SURFACE TREATMENT

This application claims benefit of the filing date of Provisional Application No. 60/203,404, filed May 11, 2000.

FIELD OF THE INVENTION

This invention relates to an abrasive water jet ("AWJ") peening surface treatment for providing a textured surface with specific surface topography on metals. In particular, this invention relates to the use of a high velocity AWJ as a mechanical surface treatment process that simultaneously textures and work hardens the surface of a metal substrate through controlled hydrodynamic erosion. One embodiment of this invention can be used to provide a textured surface on metal orthopedic implants.

BACKGROUND OF THE INVENTION

Total joint arthroplasty is one of the most common surgical treatments for those who suffer from debilitating arthritis. Though successful at restoring joint mobility, clinical surveys have determined that the long-term success of total joint arthroplasty is often impaired by the loss of fixation between the prosthesis and the bone in cementless arthroplasty or between the prosthesis and the bone cement. Mechanical loosening of implants from the bone or cement can result in excessive joint displacement and generally mandates the need for revision surgery. Therefore, the development of stable primary fixation is a critical requirement for successful total joint arthroplasty.

Porous coatings can be applied (or added) to the surface of prosthetic devices to foster stable device fixation and is the conventional means of providing a textured surface for the bonding of implants to the bone. The coating serves as a source for mechanical interlocking and may stimulate healthy bone growth through Osseo integrated load transfer in cementless arthroplasty. Interestingly, some researchers have concluded that the surface texture of prosthetic devices may be designed to maximize the rate and extent of fixation through healthy cell growth. Three of the most common surface coatings used for metal implants include sintered beads, diffusion bonded wire mesh, and metallic plasma sprays. Clinical reports have clearly substantiated the benefits of these surfaces to the long-term success of implanted components. According to intermediate post-surgery follow ups, porous coated components have the ability to maintain fixation with probability of survival exceeding 0.95.

However, there is a substantial problem with the use of these coatings. Although porous coatings are considered a requirement for stable primary fixation, the fatigue strength of porous coated titanium and cobalt chrome devices (Ti6Al4V and CoCrMo) is sacrificed. The reduction in fatigue strength results from the stress concentration posed by the porous surface topography and through microstructural changes invoked during coating deposition. Together these features facilitate accelerated fatigue crack initiation in the surface of a device with inferior fatigue resistance. Early component failures, within 1 to 3 years post operative, are nearly always associated with fatigue crack initiation at the textured surface. Although increasing the component size can reduce stresses in vivo and extend the prosthesis fatigue life, stress shielding and bone resorption may develop due to the corresponding increase in component stiffness. Therefore, an alternative method of surface treatment is sought which supports stable fixation without sacrificing the component's fatigue strength.

The long-term success of total joint arthroplasty requires the development of stable primary fixation. Consequently, the device surface texture and apparent volume available for bone ingrowth and/or cement interdigitation is of critical importance. Apart from the importance of fixation, the component fatigue strength must exceed that required to achieve an infinite life with acceptable reliability. Hence, the apparent stress concentration resulting from the component surface texture is an important factor and may be detrimental to the prosthesis fatigue strength.

Furthermore, according to principles of solid mechanics, surfaces with a high effective stress concentration will generally exhibit a relatively short fatigue life. Thus, it is advantageous to maximize the volume available for interdigitation through the implant surface topography while simultaneously minimizing the apparent stress concentration. In addition to the influence of stress concentrations, residual stresses are also important to the fatigue strength of orthopedic implants. Residual stresses within the prosthesis resulting from surface treatments may superpose with stresses imposed by external loads carried through the joint. A compressive residual stress serves to reduce the effective stress at the component surface and is generally found to increase the fatigue life of metals. Conversely, tensile residual stresses are detrimental. Plasma spray treatments of metal implants result in tensile residual stresses within the coating surface and therefore may reduce the component fatigue strength. Although post-process heat treatments can be used to relieve tensile residual stresses, it would be advantageous to generate a compressive residual stress within the textured surface of implants during primary processing.

SUMMARY OF THE INVENTION

It is an object of the present invention to provide a method and apparatus to achieve an abrasive water jet peening surface treatment that overcomes the problems encountered in the prior art discussed above.

Specifically, the present invention provides a method and apparatus that includes supporting a metal workpiece on a workpiece support and arranging a nozzle above a target surface of the workpiece supported on the workpiece support so that the nozzle is pointed towards the target surface of the workpiece. A pressurized fluid is then generated by a device such as a pump, and abrasive particles are entrained within the pressurized fluid. The pressurized fluid having the entrained abrasive particles is discharged through the nozzle and toward the target surface of the workpiece. The nozzle is located a texturing standoff distance from the target surface such that the periphery of the pressurized fluid stream discharged from the nozzle expands after being discharged from the nozzle and prior to impinging upon the target surface of the workpiece. As a result, a textured (i.e., deformed) and hardened surface is created on the workpiece, and the textured surface allows the workpiece to be securely fixed to bone in the form of a prosthesis, while the hardening significantly increases the effective life of the workpiece.

Several types of abrasive particles can be used with the method and apparatus of the present invention. In particular, biocompatible abrasive particles, such as hydroxyapatite, can be used for stimulation of bone growth. In addition, garnet abrasive particles can also be used, and the particles can have various sizes depending on the desired results. The abrasive particles can be supplied into the pressurized fluid upstream of the nozzle at a flow rate in the range of 45 grams per minute to 180 grams per minute while the pressurized fluid is discharged through the nozzle.

Generally, the nozzle is oriented so that the pressurized fluid discharge from the nozzle impinges upon the target surface of the workpiece at an angle of at least 20 degrees with respect to the target surface. In addition, the nozzle is arranged with respect to the workpiece support so that the texturing standoff distance between the nozzle and the target surface of the workpiece is preferably at least 25 mm, and preferably no greater than 200 mm. This distance allows sufficient expansion of the periphery of the pressurized jet stream to avoid cutting or machining effects, while still allowing for sufficient deformation and hardening of the workpiece surface. In addition, at least one of the nozzle and the workpiece support can be moved during the discharge of the pressurized fluid so that the pressurized fluid moves across the target surface of the workpiece in a cross-hatch pattern as the pressurized fluid impinges upon the target surface. Therefore, the texturing (i.e., deforming) and hardening can be applied to the entire target surface.

BRIEF DESCRIPTION OF THE DRAWINGS

FIG. 2 is a table of the parametric conditions tested in AWJ peening of Ti6Al4V material specimen.

FIG. 3 is a table of the surface parameters of the Ti6Al4V specimens tested.

FIG. 4 is a table ofthe effective stress concentration and volume interdigitation of the Ti6Al4V specimen surfaces.

FIG. 5 is a table of the residual stress resulting from the AWJ peening of the Ti6Al4V specimens.

DETAILED DESCRIPTION OF THE INVENTION

In relation to other more common methods of manufacturing, the abrasive water jet ("AWJ") peening surface treatment may be considered as a combination of abrasive water jet machining and shot peening to deform and harden a workpiece. The process consists of propelling a high pressure abrasive-laden liquid jet (such as a water jet) through a nozzle and onto a target surface of a workpiece at a selected angle of jet impingement.

The nozzle is arranged so as to be located a texturing standoff distance from the target surface. The texturing standoff distance is generally larger than a standoff distance utilized in the known practice of abrasive water jet machining or cutting. For purposes of this invention, this texturing standoff distance is defined as a distance that will allow the periphery of the abrasive water jet stream to expand prior to impingement so as to create the desired textured surface on and the desired hardening of the target surface of the workpiece. The texturing standoff distance also serves to increase the treatment surface area, and will vary according to the other process parameters, such as the selected angle of impingement, the pressure of the water jet, and the size of the abrasive particles. Considering these other factors, approximately 25 mm is the preferred minimum texturing standoff distance for allowing sufficient jet expansion prior to impingement so as to avoid machining effects, while a maximum texturing standoff distance of approximately 200 mm is preferred in order to achieve sufficient deformation and hardening of the target surface. As explained above, these distances are related to the other process parameters. For example, at a texturing standoff distance of 25 to 35 mm, a water pressure of approximately 50–80 MPa would generally be sufficient to achieve satisfactory deformation and hardening without machining effects, while at a larger standoff distance of 140 to 160 mm, a larger water pressure of about 270–300 MPa would be preferred to achieve the desired deformation and hardening.

Furthermore, the amount of abrasives carried by the abrasive-laden water is substantially smaller than that necessary for machining, and was measured in terms of flow rate during testing of the present invention. In order to achieve proper deformation without cutting or machining of the workpiece, the amount of abrasives will also depend on the other process parameters, such as the selected angle of impingement, the pressure of the water jet, and the standoff distance. In general, however, it was found that flow rates of between 45 grams per minute and 180 grams per minute of abrasive material will achieve the desired deformation without a machining effect.

Figure 1A:
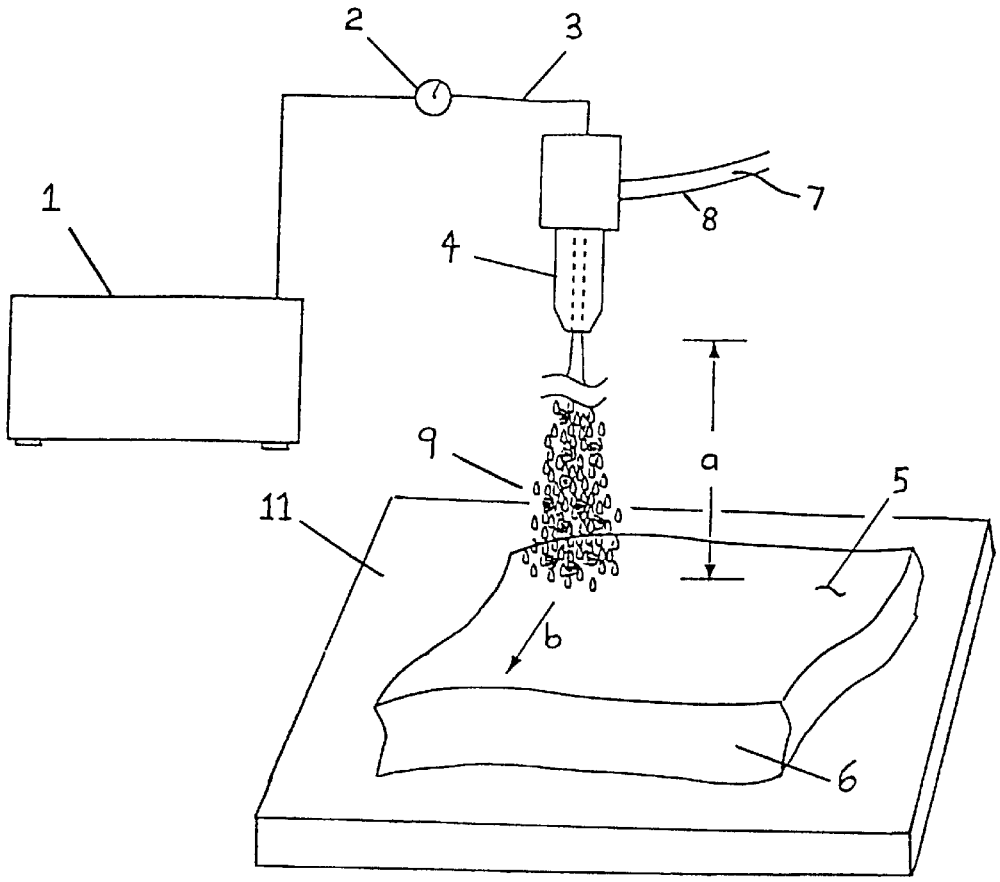
FIG. 1A is a schematic diagram of the apparatus for performing the AWJ peening process.

A schematic diagram of the process is shown in FIG. 1A. Hydraulic pump 1 generates water pressure, which is measured by pressure gauge 2. The pressurized water flows through a conduit 3 and into a water jet nozzle 4, which is located a texturing standoff distance "a" from a target surface 5 of a metal workpiece 6 to be treated. The metal workpiece is held in conventional manner (such as by clamping) on a workpiece support 11 during the abrasive water jet surface treatment process. Abrasive material 7 is supplied into the pressurized water at flow rates discussed above through an abrasive material supply tube 8 connected to the conduit 3 upstream of the water jet nozzle 4. The water jet nozzle 4 is oriented with respect to the target surface 5 so that the AWJ 9, formed of the pressurized water carrying the abrasive material 7, will exit the water jet nozzle 4 and impinge upon the target surface 5 at a preselected angle of impingement. During the AWJ peening surface treatment performed by the apparatus described above, the water jet nozzle 4 and the target surface 5 can move with respect to one another so that the AWJ 9 will move across the target surface 5 at a particular traverse speed in a direction indicated by the arrow "b" in FIG. 1. In other words, at least one of the water jet nozzle 4 and the workpiece support 11 holding the metal workpiece 6 can be moved during the AWJ peening surface treatment process by conventional methods so that the AWJ 9 impinging upon the target surface 5 will move across the target surface and, ultimately, cover the entire target surface in a traverse pattern described in more detail below.

In a first embodiment of this invention, garnet abrasive particles are used as the abrasive material 7 to create the abrasive surface area on the target surface 5 and to work harden the surface. The garnet abrasive particles are propelled at the target surface 5 of the metal workpiece, but are not intended to be imbedded into the surface. Several sizes of garnet abrasive particles can be used to treat the surface of the metal, such as abrasive mesh sizes #50, #80 and #120.

In a second embodiment of this invention, a biocompatible material such as hydroxyapatite is used as the abrasive material 7 that treats the surface of the metal. In addition to being propelled toward the metal workpiece so as to create the textured surface and to work harden the metal workpiece, these abrasives are purposely imbedded into the surface of the metal workpiece. This type of abrasive material has the ability to chemically stimulate bone growth while at the same time creating the textured surface area and strain hardening the metal workpiece that characterizes the AWJ peening surface treatment of the present invention. For some other biocompatible materials that are not as hard as hydroxyapatite, a carrier abrasive material will be necessary to imbed the bone growth stimulating material into the surface.

Figure 1B:
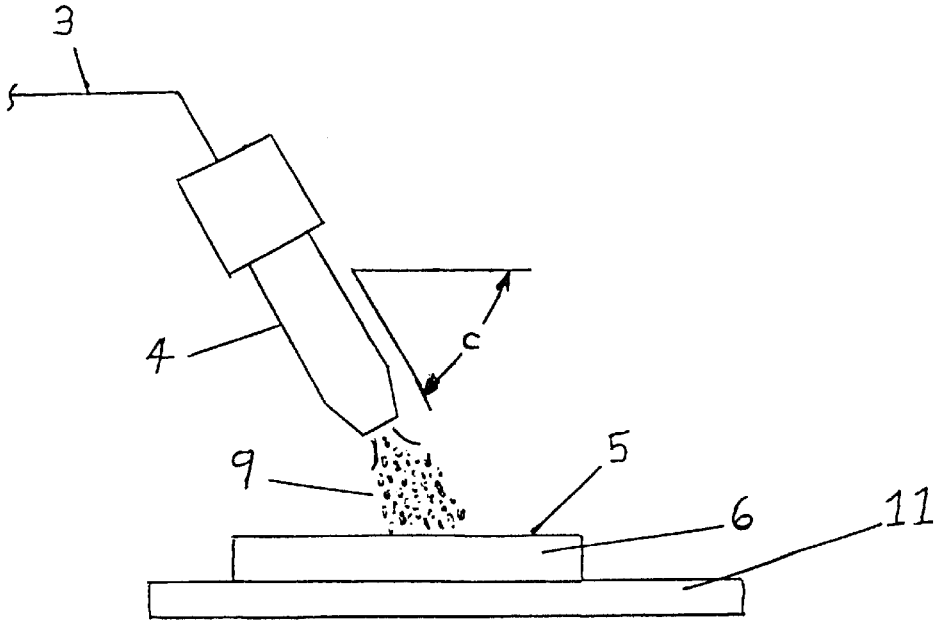
FIG. 1B is a schematic diagram of the apparatus showing a detail of the orientation of the nozzle.

During the testing of the AWJ peening surface treatment method and apparatus, a device such as Model 2652 from OMAX Corp., Auburn, Wash., was used to propel a controlled mixture of abrasives and pressurized water (AWJ) onto the target surface of a metal workpiece. As shown in FIG. 1B, the orientation of the nozzle 4 with respect to the metal workpiece can be adjusted so that the angle "c" of the AWJ impingement upon the target surface 5 is set at between 20° and 90°, depending on the specific surface features and magnitude of residual stress required. At increasingly shallow angles of impingement, the abrasive water jet exhibits microchipping and plowing characteristics of cutting wear. Thus, it has been found that the preferred range of 20° to 90° will keep the AWJ in the deformation wear mode with respect to the target surface of the workpiece and, thus, avoid excessive machining and cutting effects. The pressurized water, which may range from 50 MPa to 300 MPa, serves as a medium for momentum transfer to the abrasives and generates the AWJ which includes the abrasive material. The AWJ apparatus has a working envelope of 0.7 m×1.3 m, and a nozzle 4 having a 0.30 mm diameter sapphire jewel and a tungsten carbide focusing tube with a 0.9 mm diameter and a 89 mm length was used for all surface treatments performed during testing.

The purpose of the jet impingement is to invoke erosion and localized deformation of the surface of the workpiece. By making the appropriate choice of water pressure, abrasive material type, abrasive size, and angle of impingement, a specific surface texture and magnitude of residual stress can be achieved. Material removal occurs through a combination of embrittlement of the target due to repeated abrasive impact from the AWJ and microfracture. At more shallow angles of impingement, the abrasive water jet exhibits microchipping and plowing characteristics of cutting wear. Hence, the specific characteristics of material removal are a function of the nozzle orientation so as to create a specific angle of AWJ impingement and the properties of the substrate (e.g. ductility, hardness, and strain hardening behavior). As a result of the target surface deformation, the AWJ produces a residual stress within the substrate similar to that resulting from shot peening. Although the process of the present invention produces compressive residual stresses in the same way as known processes of water jet machining or water jet peening, the present invention is different from those related processes because those processes do not create the abrasive surface texture that results from the AWJ peening process of the present invention and which is required for prosthetic device success. Because other surface integrity factors can be controlled through proper selection of the cutting conditions, AWJ peening conditions are selected to produce a surface that supports interdigitation (cement or bone) and simultaneously provides a target surface compressive residual stress, which is important to the component fatigue life.

Experiments

A Grade 5 titanium alloy workpiece of composition Ti6Al4V was subjected to the AWJ peening process of the present invention during each experiment. The workpiece was in plate form and had a thickness of 6.35 mm, an elastic modulus of 113 GPa, a yield strength of 900 MPa, an ultimate strength 980 MPa, and an elongation of 16%.

Figure 6A:
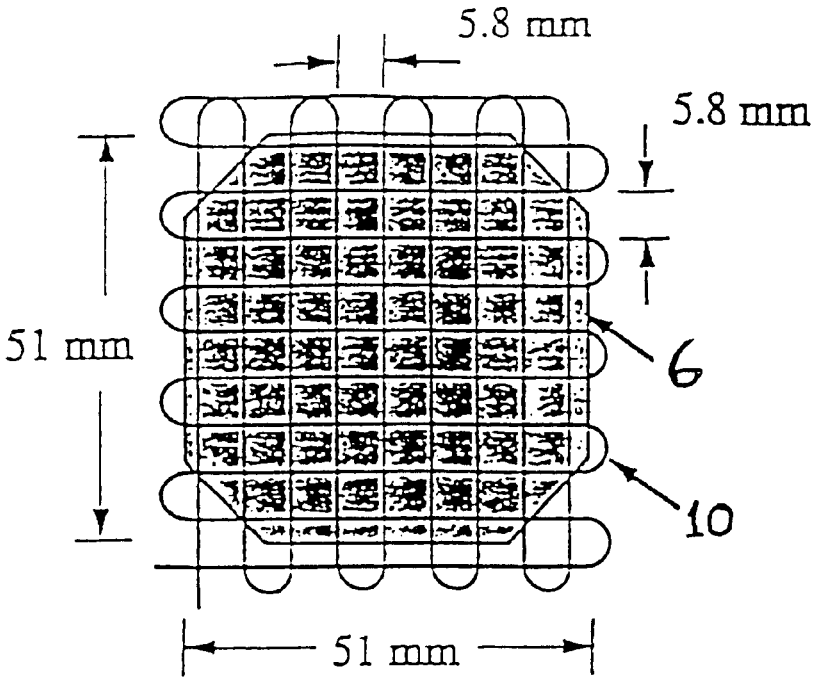
FIG. 6A is a plan view of a specimen surface showing the surface treatment pattern used for AWJ peening.

A total of 12 experiments, each with a different combination of parametric conditions, were performed for surface treatment of the workpiece as seen in FIG. 2. Four water pressures ranging from 80 MPa to 280 MPa and three different mesh sizes of abrasive material (#50, #80, and #120) were used in the experimental test plan. The standoff distance and traverse speed (i.e., moving speed of the AWJ across the target surface) were held constant at 0.15 m and 3.81 m/min, respectively, which resulted in a jet treatment diameter of approximately 16 mm. Peening of the titanium alloy workpiece was conducted at normal angles of jet impingement, and the AWJ was moved across the target surface in a traverse pattern as shown in FIG. 6A. As shown, the traverse pattern utilized a cross-hatch path 10 to insure full treatment of the entire target surface of the workpiece specimen and to minimize macroscopic surface variations associated with the erosion process.

Figure 6B:
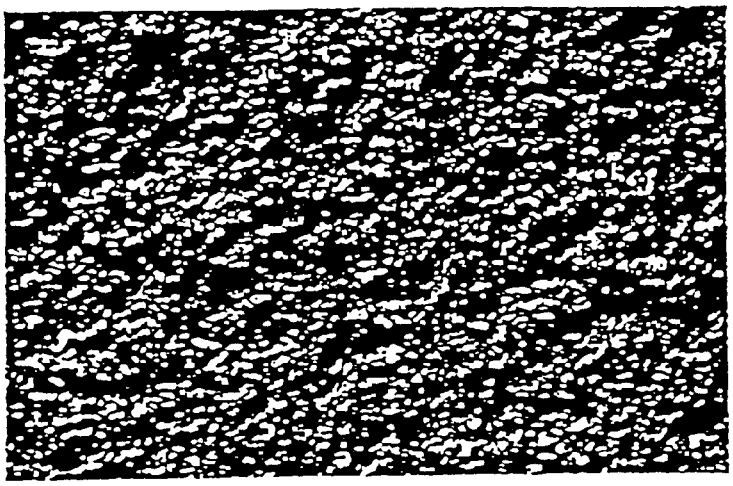
FIG. 6B is a schematic view of the resulting surface topography of a specimen treated with the present invention.

Following the surface treatment process using the AWJ, specimens representative of the treated surface of the workpiece were sectioned from the workpiece for further analysis. Each specimen was approximately 51 mm×51 mm as shown in FIG. 6A. A macroscopic view of the surface topography resulting from AWJ peening of the Ti6Al4V workpiece with a water pressure of 280 MPa and garnet abrasive size of #80 mesh is shown in FIG. 6B.

Figure 8A:
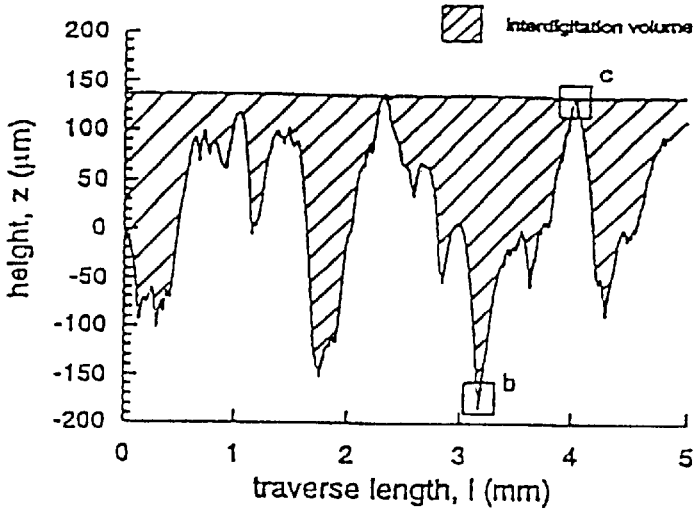
FIG. 8A is a graphs indicating the surface profile obtained from a plasma sprayed femoral component showing the surface profile of the component and interdigitation volume.

The long-term success of total joint arthroplasty requires the development of stable primary fixation. Consequently, the device surface texture and apparent volume available for bone ingrowth and/or cement interdigitation is of critical importance. The total volume available for cement interdigitation ($V_i$) or bone ingrowth may be calculated from the raw surface profile of an implant through integration, or estimated in terms of standard surface roughness parameters according to:

$$V_i = \frac{R_{pk}(M_{r1})}{200} + \left(R_{pk} + \frac{R_k}{2}\right) \cdot \frac{(M_{r2} - M_{r1})}{100} + \left(R_{pk} + R_k + \frac{R_{vk}}{2}\right) \cdot \frac{(100 - M_{r2})}{100} \quad (1)$$

where the quantities $R_{pk}$, $R_k$, and $R_{vk}$ in Equation (1) are the reduced peak height, core roughness, and reduced valley height, respectively, and $M_{r1}$ and $M_{r2}$ are the peak and valley material ratios for the surface profile. An example of the interdigitation volume from the raw surface profile of a plasma sprayed femoral component is shown in FIG. 8A. Note that the expression for $V_i$ in Equation (1) defines the interdigitation volume over the profile traverse length per unit surface width (assuming that the texture is isotropic). For a perfectly smooth surface, the quantities $R_{pk}$, $R_k$, and $R_{vk}$ of surface roughness are all equal to zero, and there is no volume available for interdigitation or osseointegration as indicated by Equation (1). The integrity and strength of component fixation is expected to increase with increasing $V_i$.

Figure 8B:
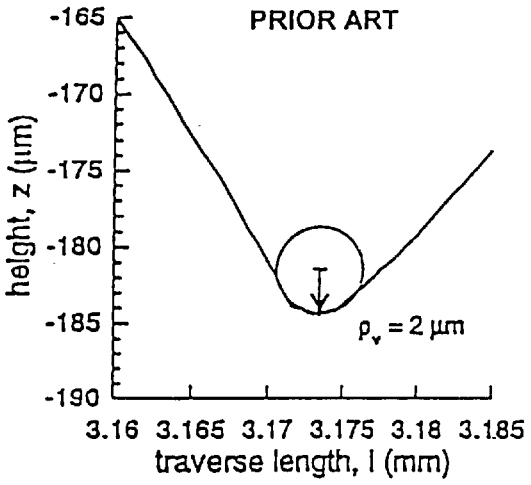
FIG. 8B is a graph indicating the surface profile obtained from a plasma sprayed femoral component showing a typical valley radius.
Figure 8C:
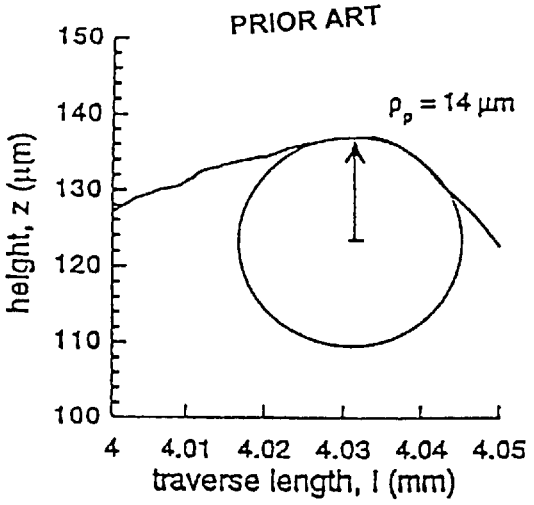
FIG. 8C is a graph indicating the surface profile obtained from a plasma sprayed femoral component showing a typical peak radius.

Apart from the importance of fixation, the component fatigue strength must exceed that required to achieve an infinite life with acceptable reliability. Hence, the apparent stress concentration resulting from the component surface texture is an important factor and may be detrimental to the prosthesis fatigue strength. For a surface with irregularities, the effective stress concentration ($\overline{\kappa}_t$) can be calculated from the surface profile in terms of standard roughness parameters according to:

$$\overline{K}_t = 1 + n\left[\frac{R_a}{\overline{\rho}} \cdot \frac{R_y}{R_z}\right] \quad (2)$$

where the quantities $R_a$, $R_y$ and $R_z$ are the arithmetic average roughness, peak to valley height, and ten point roughness, respectively. The effective profile valley radius ($\overline{\rho}$) can be determined from a single profile using a graphical radius gage. In an evaluation of surfaces for cemented arthroplasty, the effective stress concentration within the component, and within the cement, must both be considered using the effective profile valley ($\overline{\rho}_v$)and profile peak radii ($\overline{\rho}_p$), respectively. A surface profile valley radius ($\rho_v$) and peak radius ($\rho_p$) from the surface profile of the plasma spray coated femoral component are illustrated in FIGS. 8B and 8C, respectively. According to principles of solid mechanics, surfaces with a high effective stress concentration will generally exhibit a relatively short fatigue life. Thus, it is advantageous to maximize the volume available for interdigitation through the implant surface topography while simultaneously minimizing the apparent stress concentration.

In addition to the influence of stress concentrations, residual stresses are also important to the fatigue strength of orthopedic implants. Residual stresses within the prosthesis resulting from surface treatments may superpose with stresses imposed by external loads carried through the joint. A compressive residual stress serves to reduce the effective stress at the component surface and is generally found to increase the fatigue life of metals. Conversely, tensile residual stresses are detrimental. Plasma spray treatments of metal implants result in tensile residual stresses within the coating surface and, therefore, may reduce the component fatigue strength. Although post-process heat treatments can be used to relieve tensile residual stresses, it would be advantageous to generate a compressive residual stress within the textured surface of implants during primary processing.

Surface profiles of the AWJ-treated Ti6Al4V workpiece samples were obtained using a stylus surface profilometer (Model T8000 Profilometer, Hommel, New Britain, Conn.). A skidless contact probe with a 10 $\mu$m diameter was used for all measurements. Surface profiles were used in calculating $R_a$, $R_y$ and $R_z$ in accordance with ANSI B46.1 using a profiles were used in calculating $R_a$, $R_y$ and $R_z$ in accordance with ANSI B46.1 using a measurement traverse length of 4.8 mm and cutoff length of 0.8 mm. In addition to the standard roughness parameters, the material ratio curve was used in calculating the $R_k$ parameters ($R_k$, $R_{vk}$, and $R_{pk}$) and material ratios ($M_{r1}$ and $M_{r2}$) according to DIN 4776. The surface roughness parameters were recorded to support a quantitative comparison of the surface topography resulting from different treatment conditions and for calculation of $\overline{\kappa}_t$ and $V_i$ according to their definitions in Equations (1) and (2). The effective peak and valley radii, which are required for calculation of $\overline{\kappa}_t$, were determined from the surface profiles using a graphical radius gage. In addition to the use of contact profilometry, an evaluation of the microscopic features of the treated surfaces was conducted with a Jeol JSM T35 scanning electron microscope (SEM). All surfaces resulting from AWJ peening were compared to the surface of a plasma-sprayed Ti6Al4V femoral component, which served as a benchmark.

Figure 7A:
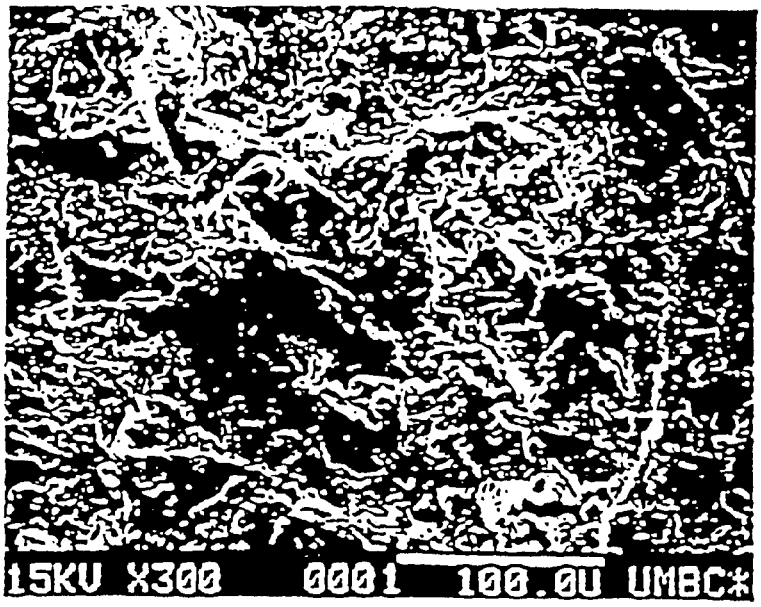
FIG. 7A is a micrograph of the morphological features of a Ti6Al4V specimen surface after AWJ peening of the surface at 280 Mpa using #50 mesh garnet.

Microscopic features of the Ti6Al4V surfaces that resulted from AWJ peening were examined using the SEM. An electron micrograph taken from the surface of specimen 1, which was treated with a water jet pressure of 280 MPa containing garnet abrasive material of mesh size #50, is shown in FIG. 7A. Microscopic features of the surface from all specimens were similar in nature regardless of the parametric conditions used for treatment. Characteristics of plastic flow were clearly evident from the marked surface indentations, which resulted from repeated abrasive bombardment. Deformation wear tracks on the surface appeared random in nature owing to the irregularities in abrasive size, shape, and variability in the angle of impingement.

Figure 7B:
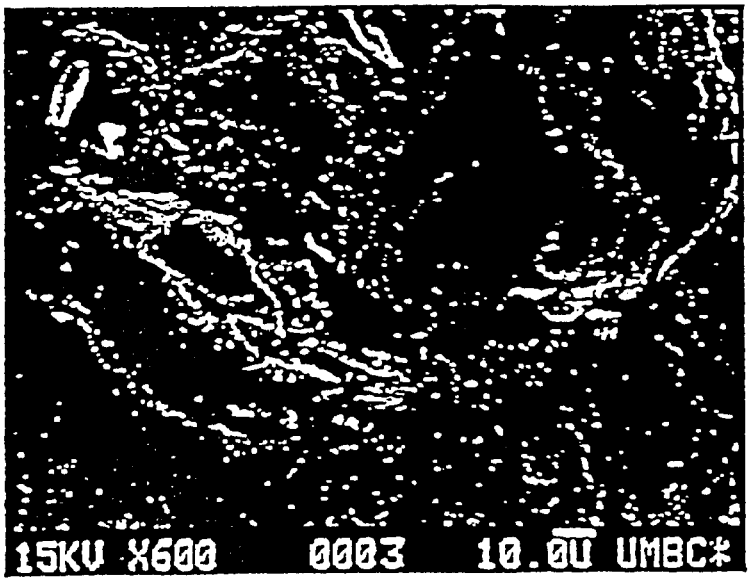
FIG. 7B is a micrograph of the morphological features of the Ti6Al4V specimen surface after AWJ peening of the surface at 280 Mpa using #80 mesh garnet in which evidence of abrasive impregnation is shown.

Interestingly, a few particles of the garnet abrasive material were found to remain on the Ti6Al4V workpiece surface after treatment, despite being subjected to an ultrasonic cleaning. An electron micrograph highlighting abrasives that have been partially impregnated within the Ti6Al4V surface is shown in FIG. 7B. The deposited abrasives indicated in this figure resulted from treatment at a water jet pressure of 280 MPa containing garnet abrasive material of mesh size #80. Although measurements concerning the extent of abrasive particles remaining on the surface were not made, the frequency of abrasive particles adhering to the surface increased with increased jet pressure and with the use of smaller mesh sizes of abrasive materials. The initial embodiment using garnet abrasive particles provides the most effective surface treatment when the abrasive particles are not to be deposited onto the surface. In the alternative embodiment using hydroxyapatite particles, however, a generally larger number of particles will adhere to the target surface. As discussed above, the hydroxyapatite material has been found to chemically stimulate bone growth so as to further improve the fixation of a prosthesis to bone. Therefore, propelling the abrasive hydroxyapatite particles at the target surface should be a more effective way of providing a surface for body tissue to attach to a prosthesis.

Figure 9A:
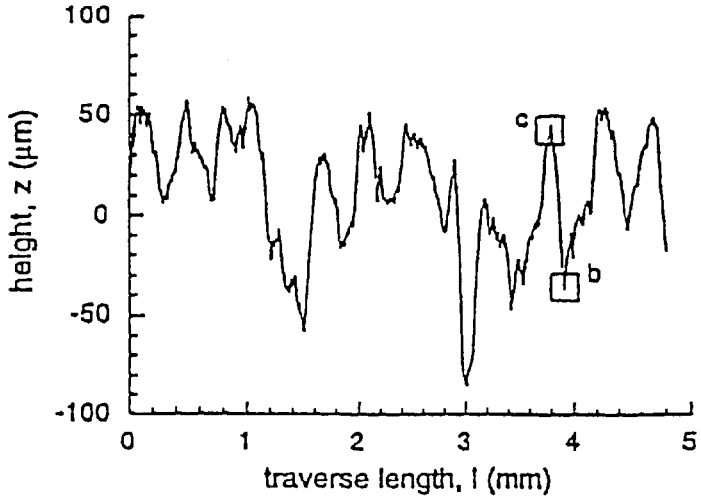
FIG. 9A is a graph showing surface profile resulting from AWJ peening of the Ti6Al4V specimen at 280 Mpa using #50 mesh garnet.

A representative surface profile resulting from AWJ peening of the Ti6Al4V workpiece is shown in FIG. 9A. The profile in this figure was obtained from the surface of specimen 1, which was treated using a water jet pressure of 280 MPa containing abrasive material of mesh size #50 (see FIG. 2). A surface profile obtained from the surface of a commercial titanium femoral component with plasma spray coating is available for comparison in FIG. 8A. Surface roughness characteristics for the Ti6Al4V workpiece specimens were calculated from the respective surface profiles of each specimen and are listed in FIG. 3. The corresponding roughness characteristics were also calculated for surface profiles obtained from the plasma sprayed femoral component. Overall, the surface roughness resulting from AWJ peening was lower than that of the plasma sprayed surface. The highest average surface roughness ($R_a$) of the AWJ-peened specimens was 14.2 $\mu$m and resulted from being treated with the highestjet pressure containing abrasive material of mesh size #50 as shown in FIG. 3. In comparison, the plasma sprayed femoral component exhibited an average surface roughness exceeding that of all AWJ peened surfaces by a factor of 2 (28.9 $\mu$m). Similar to the trend in average roughness, the maximum peak to valley height ($R_y$) and ten point roughness ($R_z$) of the AWJ-peened T16A14V workpiece was slightly less than one half that of the plasma sprayed surface.

For each AWJ-peened surface, the interdigitation volume was calculated according to Eqn. 1 using the $R_k$ family of surface roughness parameters. FIG. 4 contains the $V_i$ resulting from each of the twelve treatment conditions. As expected, the AWJ-peened surface with largest $V_i$ resulted from treatment at the highest jet pressure and with the largest abrasives (specimen1). Furthermore, the range of parameters used for AWJ peening resulted in significant changes in the surface structure and corresponding volume available for interdigitation. Nevertheless, the plasma sprayed component surface topography provided a $V_i$ nearly twice as large as that of the AWJ peened specimens as evident from a comparison of the volumes in FIG. 4. Note that $V_i$ in FIG. 4 represents the apparent volume available for interdigitation of cement or bone assuming that complete interdigitation is obtained. However, the true interdigitation volume achieved from surgical placement may be less than the volume shown in FIG. 4 due to various reasons (e.g. polymerization shrinkage, cement viscosity, inadequate pressure, void content of the cement, etc.).

Figure 9B:
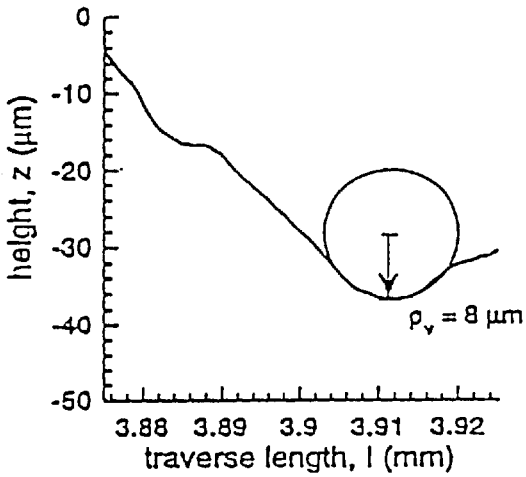
FIG. 9B is a graph showing an effective peak radius resulting from AWJ peening of the Ti6A14V specimen at 280 Mpa using #50 mesh garnet.
Figure 9C:
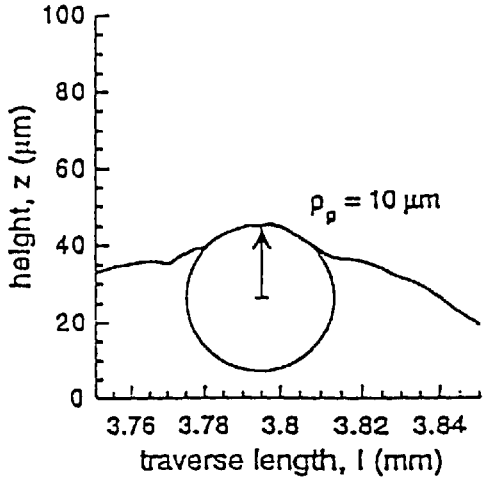
FIG. 9C is a graph showing an effective peak radius resulting from AWJ peening of the Ti6A14V specimen at 280 Mpa using #50 mesh garnet.

The surface profiles from each AWJ-peened specimen were also used in determining the effective peak radius ($\overline{\rho}_p$) and valley radius ($\overline{\rho}_v$). A distinction of these quantities on the surface of specimen 1 is shown in FIG. 9. As evident from a comparison between FIG. 8 (plasma spray coating) and FIG. 9 (AWJ peening), $\overline{\rho}_v$ resulting from the plasma spray coating is much smaller than that resulting from AWJ peening. Profile radii measurements were used in calculating the effective stress concentration factors ($\overline{\kappa}_t$) within the component and within the cement (assuming complete interdigitation) according to Equation (2). The $\overline{\kappa}_t$ resulting from AWJ peening of the Ti6Al4V specimens are listed in FIG. 4. The largest effective stress concentration resulted from AWJ peening of specimen 7, which was treated with a water jet pressure of 140 MPa containing the largest mesh size of abrasives. According to Equation (2), the $\overline{\kappa}_t$ for specimen 7 was found to be 2.7, whereas the $\overline{\kappa}_t$ of the plasma sprayed coating was found to be 8.4. Hence, the plasma sprayed component surface exhibits an effective stress concentration that is at least 3 times that of the AWJ-peened surfaces. FIG. 8B clearly shows that the excessive effective stress concentration of the plasma spray coating results from the small valley radius. The profile peak radius ($\rho_p$) for both the plasma sprayed component and AWJ-peened surfaces appeared very random in form when compared to the variation in $\rho_v$. Values of $\rho_p$ for all surfaces, including the plasma sprayed component, were found to range from 8 $\mu$m to over 40 $\mu$m. Hence, the effective stress concentration in the cement resulting from the component surface topography are not listed in FIG. 4, but ranged from 1.4 to 3.2 for the AWJ-peened surfaces and from 1.9 to 4.6 for the plasma sprayed surface.

A residual stress analysis of the surfaces was conducted with an x-ray diffractometer (Model 1830 Generator and PW 1710/00 Diffraction Control Unit, Phillips) using Copper kV radiation with a wavelength ($\lambda$) of 1.54060 Å and a beam width of 0.5 mm at 40 kV and 30 mA. Peak intensities of the diffraction patterns were recorded at $\pm\psi$ tilts of 0°, 17.46°, 25.18°, 31.37° and 36.99° with $\phi$ angles of 0°, 45° and 90°. The residual stress state of each specimen was determined from a total of 30 diffraction measurements. Negative $\psi$ tilts were conducted with pseudo-negative $\psi$ angles. Peak positions of the diffraction intensity corresponding to the 213 plane were recorded for each $\phi$, $\psi$, combination, and all peak intensities were corrected for Lorentz polarization, absorption, and background intensity using a linear correction. Peak positions of the diffraction patterns were found from the center of gravity and used to determine the lattice plane spacing according to Bragg's Law. The magnitude of biaxial residual stress was determined from residual strain measurements using the $\sin^2\psi$, method of analysis according to:

$$\frac{d_{\phi\psi} - d_o}{d_o} = \frac{1+\nu}{E}\sigma_\phi \sin^2\psi - \frac{\nu}{E}(\sigma_{11} + \sigma_{22}) \tag{3}$$

where the quantities E and $\nu$ correspond to the elastic modulus and Poisson's ratio for the Ti6Al4V abrasive material, and $\sigma_\phi$, is given by:

$$\sigma_\phi = \sigma_{11}\cos^2\phi + \sigma_{22}\sin^2\phi \tag{4}$$

where the quantities $d\phi\psi$ and $d_o$ in Equation (3) refer to the lattice spacing within the substrate at a specific orientation of x-ray incidence ($\phi$, $\psi$), and the unstressed lattice spacing, respectively. The $\sin^2\psi$ method of analysis provides an average value of the in-plane stress distribution over the depth of x-ray penetration. For Cu irradiation of Ti6Al4V, the absorption coefficient was determined to be 9.025 $m^{-1}$ and the corresponding depth of x-ray penetration for 99% absorption was 12.1 $\mu$m.

Residual stresses resulting from AWJ peening of the Ti6Al4V specimens were computed using the $\sin^2\psi$ method of analysis according to Equation (3). The biaxial stress within each of the specimens determined using this method is listed in FIG. 5. It was found that the residual stress resulting from all conditions of AWJ peening in this study were compressive, and the magnitude of stress ranged from near 30 MPa to over 400 MPa and was strongly dependent on the treatment conditions. The largest compressive residual stress resulted from AWJ peening of specimen 12, which was treated with a jet pressure of 70 MPa containing abrasive material of mesh size #120. Previous studies have shown that plasma spray coating of Ti6Al4V results in the development of a biaxial tensile residual stress and can reach values as high as 450 MPa. Note that the biaxial stresses presented in FIG. 5 represent the average stress determined over the approximately 12 $\mu$m depth of x-ray penetration.

Subsurface residual stress gradients resulting from AWJ peening are also a significant element of the surface integrity and will be identified in future studies.

Figure 10A:
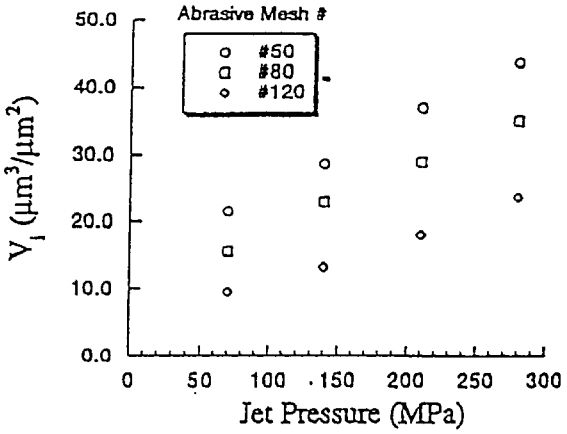
FIG. 10A is a graph indicating the influence of the surface treatment of the Ti6Al4V specimen resulting from AWJ peeing on the interdigitation volume of the specimen.
Figure 10B:
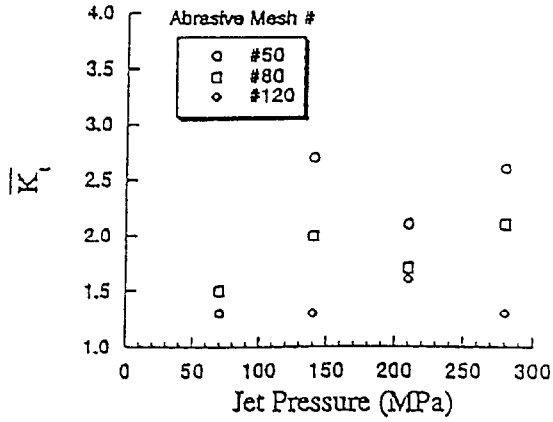
FIG. 10B is a graph indicating the influence of the surface treatment of the Ti6Al4V specimen resulting from AWJ peening on the effective stress concentration of the specimen.
Figure 10C:
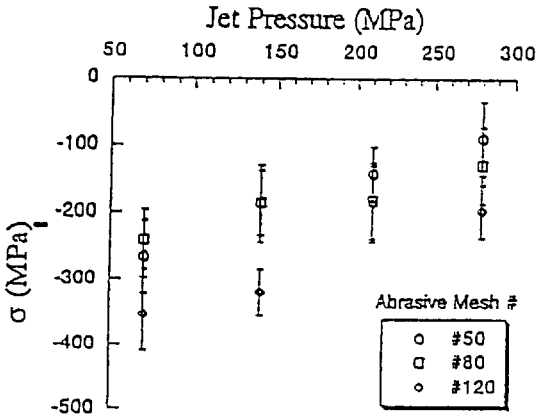
FIG. 10C is a graph indicating the influence of the surface treatment of the Ti6Al4V specimen resulting from AWJ peening on the plane residual stress of the specimen.

As can be seen from the above discussion, AWJ peening of the Ti6Al4V material workpiece results in a surface topography that facilitates interdigitation (of cement or bone). In addition, the effective stress concentration and residual stress state of the AWJ peened surfaces, which are important to the component fatigue life, can be modified by the proper selection of treatment parameters. The influence of jet pressure and abrasive size on $V_i$, $\overline{\kappa}_t$ and the in-plane biaxial residual stress of the AWJ-peened Ti6Al4V workpiece are shown in FIGS. 10A–10C. As evident from those figures, an increase in the jet pressure and abrasive mesh size result in an increase in $V_i$ and an increase in $\overline{\kappa}_t$ as shown in FIGS. 10A and 10B, respectively, and also result in a reduction in the in-plane residual stress as shown in FIG. 10C. While an increase in $V_i$ would favor stable fixation, an increase in $\overline{\kappa}_t$ and decrease in the residual stress would be detrimental to the component fatigue strength. It is possible to further increase the magnitude of compressive residual stress without increasing $\overline{\kappa}_t$ through proper selection of the parameters. According to the characteristics evident in FIG. 10, AWJ peening with low jet pressures resulted in the maximum residual stress and lowest $\overline{\kappa}_t$. However, low jet pressures also resulted in the lowest degree of volume available for interdigitation.

Due to the reduction in fatigue strength resulting from the application of porous coatings, significant effort has been placed on increasing the fatigue strength of orthopedic implants. Postsintering heat treatments have been proposed to modify the microstructure and increase the fatigue strength of Ti6Al4V implants following the deposition process. Though encouraging, parametric analyses have shown that post-deposition heat treatments have little affect on the fatigue strength of porous coated Ti6Al4V workpieces in relation to the stress concentration. Moreover, researchers have not found statistically significant changes in the fatigue strength of Ti6Al4V stems with sintered beads after conducting heat treatments. The fatigue strength was found to be 285±64 MPa following the post-sinter heat treatment while the fatigue strength of Ti6Al4V in wrought form is near 600 MPa. Thus, notch effects promoted by the surface topography appear to dominate the fatigue life of porous coated components. Indeed, profile valley radii determined from the femoral component surface profile in FIG. 8B reveals the significance of notches resulting from plasma spray coatings and the likelihood of fatigue crack initiation at these sites. The AWJ-peened surfaces exhibited much larger profile valley radii than that of the plasma sprayed surface and, consequently, are subject to much lower effective stress concentration.

A reduction of the surface stress concentration factor imposed by porous coatings may be achieved through macroscopic changes of the surface geometry. For example, the stress concentration factor that develops within a component with a sintered beads coating can be substantially reduced by only applying the beads to surface plateaus which are spaced between macroscopic recesses. An experimental verification of this concept reveals that the fatigue strength can be increased by over 100% in comparison with the sintered bead coating applied to surfaces without macroscopic relief. Nevertheless, the fatigue strength remains far lower than that for the alloy in wrought form. Abrasive water jet peening provides a superior fatigue strength to that available from deposited coatings through the ability to simultaneously control $\overline{\kappa}_t$ and the magnitude of compressive residual stress. Additional studies are necessary to validate the process capabilities and distinguish the effects of AWJ peening on the fatigue strength of orthopedic biomaterials.

In contrast to deposition surface treatments, AWJ peening results in a surface that is an integral component of the treated substrate. Consequently, many concerns regarding the coating/substrate interface and coating porosity are no longer pertinent. An increase in $V_i$ resulting from AWJ peening is available through proper selection of the treatment parameters or through the use of alternative abrasive systems. For example, abrasive particles having larger diameters with less cutting potential may increase the magnitude of compressive residual stress while maintaining the interdigitation volume (FIGS. 4 and 5). Further benefits may also be achieved by introducing macroscopic variations to the surface topography through AWJ peening.

Several specific embodiments of the present invention have been shown and described in detail to illustrate the application of the principles of the invention. However, it will be understood that the invention may be embodied otherwise without departing from such principles, and that various modifications, alternate constructions, and equivalents will occur to those skilled in the art given the benefit of this disclosure.

We claim:

1. A method comprising:

supporting a metal workpiece on a workpiece support;

arranging a nozzle above a target surface of the workpiece supported by the workpiece support such that the nozzle is pointed towards the target surface of the workpiece;

generating a pressurized fluid having entrained biocompatible abrasive particles for stimulation of bone growth; and discharging the pressurized liquid having the entrained abrasive particles through the nozzle and toward the target surface of the workpiece, wherein the nozzle is located a texturing standoff distance from the target surface such that a periphery of a pressurized liquid stream discharged from the nozzle expands after being discharged from the nozzle and prior to impinging upon the target surface of the workpiece so as to create a textured target surface on the workpiece.

2. The method of claim 1, wherein said discharging of the pressurized liquid having the entrained abrasive particles comprises discharging the pressurized liquid such that the entrained abrasive particles become imbedded in the target surface.

3. The method of claim 2, wherein the entrained abrasive particles comprise hydroxyapatite particles.

4. The method of claim 1, wherein said arranging of the nozzle includes orienting the nozzle such that the pressurized fluid discharged from the nozzle impinges upon the target surface of the workpiece at an angle of at least 20 degrees with respect to the target surface.

5. The method of claim 1, wherein the texturing standoff distance is at least 25 mm.

6. The method of claim 5, wherein the texturing standoff distance is no greater than 35 mm, and wherein said generating of the pressurized liquid comprises generating a water pressure of 50 MPa to 80 MPa.

7. The method of claim 5, wherein the texturing standoff distance is no greater than 200 mm.

8. The method of claim 5, wherein said generating of the pressurized liquid having entrained abrasive particles comprises supplying the abrasive particles into the pressurized liquid upstream of the nozzle at a flow rate in a range of 45 grams per minute to 180 grams per minute during said discharging of the pressurized liquid through the nozzle.

9. The method of claim 5, wherein said arranging of the nozzle includes orienting the nozzle such that the pressurized liquid discharged from the nozzle impinges upon the target surface of the workpiece at an angle of at least 20 degrees with respect to the target surface.

10. The method of claim 5, further comprising moving at least one of the nozzle and the workpiece support during said discharging of the pressurized liquid such that the pressurized liquid moves across the target surface in a cross-hatch pattern as the pressurized liquid impinges upon the target surface.

11. The method of claim 1, further comprising moving at least one of the nozzle and the workpiece support during said discharging of the pressurized liquid such that the pressurized liquid moves across the target surface in a cross-hatch pattern as the pressurized liquid impinges upon the target surface.

12. The method of claim 1, wherein said generating of the pressurized liquid having entrained biocompatible abrasive particles comprises supplying the abrasive particles into the pressurized liquid upstream of the nozzle at a flow rate in a range of 45 grams per minute to 180 grams per minute during said discharging of the pressurized liquid through the nozzle.

13. The method comprising:

supporting a metal workpiece on a workpiece support;

arranging a nozzle above a target surface of the workpiece support by the workpiece support such that the nozzle is pointed towards the target surface of the workpiece;

generating a water pressure of 270 MPa to 300 MPa having entrained abrasive particles; and discharging the pressurized water having the entrained abrasive particles through the nozzle and toward the target surface of the workpiece, wherein the nozzle is located a texturing standoff distance from the target surface such that a periphery of a pressurized water stream discharged from the nozzle expands after being discharged from the nozzle and prior to impinging upon the target surface of the workpiece so as to create a textured target surface on the workpiece, the texturing standoff distance being in a range of 140 mm to 160 mm.

14. The method of claim 13, wherein said generating of the pressurized water having entrained abrasive particles comprises supplying the abrasive particles into the pressurized water upstream of the nozzle at a flow rate in a range of 45 grams per minute to 180 grams per minute during said discharging of the pressurized water through the nozzle.

15. A method comprising:

supporting a metal workpiece on a workpiece support;

arranging a nozzle above a target surface of the workpiece supported by the workpiece support such that the nozzle is pointed towards the target surface of the workpiece;

generating a pressurized fluid having entrained abrasive particles; and discharging the pressurized fluid having the entrained abrasive particles through the nozzle and toward the target surface of the workpiece, wherein the nozzle is located a texturing standoff distance from the target surface such that a periphery of a pressurized fluid stream discharged from the nozzle expands after being discharged from the nozzle and prior to impinging upon the target surface of the workpiece so as to create a textured target surface on the workpiece, wherein said generating of the pressurized fluid having entrained abrasive particles comprises supplying the abrasive particles into the pressurized fluid upstream of the nozzle at a flow rate in a range of 45 grams per minute to 180 grams per minute during said discharging of the pressurized fluid through the nozzle.

16. An apparatus comprising:

a nozzle for discharging a pressurized liquid stream;

a pump for generating the pressurized liquid, said pump being connected to said nozzle by a conduit so as to supply the pressurized liquid to said nozzle through said conduit;

biocompatible abrasive particles to be supplied into the pressurized liquid stream upstream of said nozzle;

an abrasive particle supply tube connected to said conduit upstream of said nozzle for supplying said biocompatible abrasive particles into the pressurized liquid generated by said pump;

a workpiece support for supporting a metal workpiece having a target surface, wherein said workpiece support is arranged with respect to said nozzle such that said nozzle such that said nozzle is located a texturing standoff distance from the target surface of the workpiece supported by said workpiece support, whereby a periphery of the pressurized liquid stream discharged from said nozzle expands after being discharged from said nozzle and prior to impinging upon the target surface of the workpiece so as to create a textured target surface on the workpiece.

17. The apparatus of claim 16, wherein said nozzle is adapted to be moveable such that the pressurized liquid discharged from said nozzle can be made to impinge upon the target surface of the workpiece at an angle in a range of 20 degrees to 90 degrees with respect to the target surface.

18. The apparatus of claim 16, wherein said nozzle and said workpiece support are adapted such that the texturing standoff distance between the target surface of the workpiece and said nozzle can be adjusted between 25 mm and 200 mm.

19. The apparatus of claim 16, wherein said nozzle and said workpiece support are adapted such that said nozzle and said workpiece support move relative to each other as said nozzle discharges the pressurized liquid.

20. The apparatus of claim 16, wherein said nozzle has a tungsten carbide focusing tube having a diameter of 0.9 mm.

21. The apparatus of claim 16, wherein said biocompatible abrasive particles comprises hydroxyapatite particles for stimulating bone growth.

* * * * *

UNITED STATES PATENT AND TRADEMARK OFFICE

CERTIFICATE OF CORRECTION

PATENT NO. : 6,502,442 B2
DATED : January 7, 2003
INVENTOR(S) : Dwayne D. Arola et al.

It is certified that error appears in the above-identified patent and that said Letters Patent is hereby corrected as shown below:

Title page, Item [54] and Column 1, lines 1-3,
Change "METHOD AND APPARATUS FOR ABRASIVE FOR ABRASIVE FLUID JET PEENING SURFACE TREATMENT" to -- METHOD AND APPARATUS FOR ABRASIVE FLUID JET PEENING SURFACE TREATMENT --.

Signed and Sealed this

Fifteenth Day of April, 2003

JAMES E. ROGAN
*Director of the United States Patent and Trademark Office*